US011589693B2

(12) United States Patent
Pearce et al.

(10) Patent No.: US 11,589,693 B2
(45) Date of Patent: Feb. 28, 2023

(54) BED LINENS, AND RELATED BEDDING ASSEMBLIES AND METHODS

(71) Applicant: Purple Innovation, LLC, Alpine, UT (US)

(72) Inventors: Tony M. Pearce, Alpine, UT (US); Shawn D. Moon, Cedar Hills, UT (US)

(73) Assignee: Purple Innovation, LLC, Lehi, UT (US)

( * ) Notice: Subject to any disclaimer, the term of this patent is extended or adjusted under 35 U.S.C. 154(b) by 311 days.

(21) Appl. No.: 15/298,759

(22) Filed: Oct. 20, 2016

(65) Prior Publication Data

US 2018/0110348 A1 Apr. 26, 2018

(51) Int. Cl.

| | |
|---|---|
| ***A47G 9/02*** | (2006.01) |
| ***A47G 9/10*** | (2006.01) |
| ***A47C 27/08*** | (2006.01) |
| ***D04B 1/18*** | (2006.01) |
| ***A47G 9/00*** | (2006.01) |

(52) U.S. Cl.

CPC ..... *A47G 9/0246* (2013.01); *A47C 27/085* (2013.01); *A47G 9/0207* (2013.01); *A47G 9/0223* (2013.01); *A47G 9/0238* (2013.01); *A47G 9/0253* (2013.01); *A47G 9/10* (2013.01); *D04B 1/18* (2013.01); *A47G 2009/001* (2013.01); *D10B 2503/062* (2013.01)

(58) Field of Classification Search

CPC .. A47G 9/0246; A47G 9/0207; A47G 9/0223; A47G 9/0238; A47G 9/0253; A47G 9/10; D02G 3/04–047; D02G 3/32; D10B 2503/062; D04B 1/18

See application file for complete search history.

(56) References Cited

U.S. PATENT DOCUMENTS

| | | | | |
|---|---|---|---|---|
| 3,155,121 A | | 11/1964 | Seltzer et al. | |
| 4,369,284 A | | 1/1983 | Chen | |
| 4,723,331 A | * | 2/1988 | Weiss | A47G 9/0246 5/495 |

(Continued)

FOREIGN PATENT DOCUMENTS

| | | |
|---|---|---|
| CN | 104083041 A | 10/2014 |
| JP | 2001514912 A | 9/2001 |

(Continued)

OTHER PUBLICATIONS

Stretch Bamboo Rayon Jersey Knit, Apr. 20, 2013, Fabric.com. https://web.archive.org/web/20130420172833/https://www.fabric.com/creativity-headquarters-free-pattern-downloads-holiday-heroine-cape-tank-pattern-stretch-bamboo-rayon-jersey-knit.aspx (Year: 2013).*

(Continued)

*Primary Examiner* — Eric J Kurilla
*Assistant Examiner* — Amanda L Bailey
(74) *Attorney, Agent, or Firm* — Dentons Durham Jones Pinegar

(57) ABSTRACT

A bed linen comprises a single, continuous piece of fabric extending substantially completely across lateral dimensions of the bed linen and including elastomeric fibers and non-elastomeric fibers. The single, continuous piece of fabric is configured to stretch to at least 125 percent of an initial length thereof without damage thereto and to substantially return to the initial length thereof after being stretched. A bedding assembly and a method of forming a bedding assembly are also described.

19 Claims, 4 Drawing Sheets

(56) References Cited

U.S. PATENT DOCUMENTS

| | | | | |
|---|---|---|---|---|
| 5,165,128 | A | 11/1992 | Honig | |
| 5,749,111 | A | 5/1998 | Pearce | |
| 5,994,450 | A | 11/1999 | Pearce | |
| 6,026,527 | A * | 2/2000 | Pearce | A43B 13/04 5/654 |
| 6,164,092 | A * | 12/2000 | Menaker | A47G 9/0246 5/497 |
| 6,413,458 | B1 | 7/2002 | Pearce | |
| 6,983,500 | B2 | 1/2006 | Wootten | |
| 7,240,383 | B2 | 7/2007 | Stewart | |
| 7,325,263 | B2 | 2/2008 | Stribling | |
| 7,964,664 | B2 | 6/2011 | Pearce | |
| 8,015,636 | B2 | 9/2011 | Bolish et al. | |
| 8,402,580 | B2 | 3/2013 | Walvius et al. | |
| 8,566,982 | B2 | 10/2013 | Walvius et al. | |
| 8,898,834 | B1 | 12/2014 | Huber et al. | |
| 8,919,750 | B2 | 12/2014 | Pearce et al. | |
| 9,109,309 | B2 | 8/2015 | Walvius et al. | |
| 2006/0107461 | A1* | 5/2006 | Wootten, Jr. | A47G 9/0246 5/497 |
| 2006/0207296 | A1 | 9/2006 | Fujikawa | |
| 2007/0056100 | A1 | 3/2007 | Stewart | |
| 2007/0251006 | A1 | 11/2007 | Kennett | |
| 2008/0315641 | A1 | 12/2008 | Miller | |
| 2009/0107575 | A1* | 4/2009 | Ma | D03D 15/00 139/426 R |
| 2009/0193584 | A1 | 8/2009 | Stewart et al. | |
| 2012/0192595 | A1* | 8/2012 | Waldman | D04B 21/18 66/175 |
| 2013/0043628 | A1* | 2/2013 | Pearce | A47C 7/02 267/153 |
| 2014/0013507 | A1 | 1/2014 | Perez | |
| 2014/0068868 | A1 | 3/2014 | Morzano et al. | |
| 2016/0007775 | A1 | 1/2016 | Lusk | |

FOREIGN PATENT DOCUMENTS

| | | | |
|---|---|---|---|
| JP | 2006212160 | A | 8/2006 |
| KR | 1020050045819 | A | 5/2005 |
| KR | 1020150096890 | A | 8/2015 |
| WO | 1999008571 | A1 | 2/1999 |
| WO | 2006082725 | A1 | 8/2006 |

OTHER PUBLICATIONS

Heartland HomeGrown 400-Thread-Count Sateen Sheet Set. Jun. 16, 2015. Bedbathandbeyond.com. https://www.bedbathandbeyond.com/store/product/heartland-reg-homegrown-trade-400-thread-count-sateen-sheet-set/3347439?categoryId=15401 (Year: 2015).*

Elastic. (n.d.) American Heritage® Dictionary of the English Language, Fifth Edition. (2011). Retrieved Jun. 3, 2022 from https://www.thefreedictionary.com/elastic (Year: 2011).*

Barbara Breiter. "Working with Multiple Strands of Yarn". Lion Brand Notebook, https://blog.lionbrand.com/working-with-multiple-strands-of-yarn/. Accessed Jun. 3, 2022. (Year: 2014).*

What is "Tow" Definition & Explanation, 2016, http://www.textileglossary.com/terms/tow.html (Year: 2016).*

International Search Report for PCT Application No. PCT/US2017/057127 dated Jan. 30, 2018, 3 pages.

Written Opinion of the International Searching Authority for PCT Application No. PCT/US2017/057127 dated Jan. 30, 2018, 8 pages.

Chinese National Intellectual Property Administration, First Office Action, Chinese patent application No. 2017800645639, dated Jan. 3, 2020.

Taiwan Patent Office, First Office Action, Taiwan patent application No. TW106136182, dated May 1, 2019.

Taiwan Patent Office, Decision for Rejection, Taiwan application No. TW106136182, dated Jul. 24, 2019.

Canadian Intellectual Property Office, "Examiner's Report," Canadian patent application No. 3,040,500, dated May 26, 2020.

Chinese National Intellectual Property Administration, Second Office Action, Chinese Application No. 2017800645639, dated Dec. 8, 2020.

Taiwan Intellectual Property Office, Third Office Action, Taiwan Application No. 106136182, dated Oct. 30, 2020.

Chinese National Intellectual Property Administration, "First Office Action," Chinese Application No. 2017800645639, dated Aug. 31, 2020.

Chinese National Intellectual Property Administration, "Decision on Rejection", Chinese Application No. 2017800645639, dated Mar. 25, 2021.

Taiwan Intellectual Property Office, "Grounds for Rejection", Taiwan Application No. 106136182, dated Jul. 23, 2021.

Korean Intellectual Property Office, "Notice of Preliminary Rejection," Korean Application No. 10-2019-7013883, dated Oct. 28, 2021.

Japan Patent Office, "Reasons for Rejection," Japanese Application No. 2019-520434, dated Oct. 27, 2021.

European Patent Office, "Extended European Search Report," European Application No. 17861434.3, dated May 8, 2020.

"Stretch Bamboo Rayon Jersey Knit," fabric.com (retrieved from internet on May 8, 2020, http://web.archive.org/web/20130420172833/http://www.fabric.com/creativity-headquarters-free-pattern-downloads-holiday-heroine-cape-tank-pattern-stretch-bamboo-rayon-jersey-knit), Apr. 20, 2013.

Korean Intellectual Property Office, "Notice of Final Rejection," Korean Application No. 10-2019-7013883, dated Apr. 25, 2022.

Japan Patent Office, "Office Action," Japanese Application No. 2019-520434, dated Sep. 2, 2022.

Korean Intellectual Property Office "Notice of Affirmation," Korean Application No. 10-2019-7013883, dated Sep. 26, 2022.

European Patent Office, "Communication pursuant to Article 94(3) EPC," European Application No. 17861434.3, dated Nov. 3, 2022.

* cited by examiner

BED LINENS, AND RELATED BEDDING ASSEMBLIES AND METHODS

TECHNICAL FIELD

The disclosure, in various embodiments, relates generally to bed linens, and related bedding assemblies and methods. More particularly, embodiments of the disclosure relate to bed linens formed of stretchable fabric, and to related bedding assemblies and methods.

BACKGROUND

Various problems have been encountered in both the manufacture and use of conventional bed linens, such as conventional sheets (e.g., unfitted, flat sheets; fitted sheets; etc.), pillowcases, duvets, mattress pads, anti-allergy covers, blankets, quilts, etc. For example, conventional bed linens often require seams to fixedly adjoin different pieces of fabric, which can negatively affect the overall texture and softness of the bed linens. In addition, the fabrics of conventional bed linens may lack sufficient elasticity to respond to variations in mattress dimensions and/or to recover from applied distortional forces, resulting in bed linens that are unusable, prone to damage (e.g., ripping, tearing, permanent wrinkling, etc.), uncomfortable, and/or unattractive. Moreover, the fabrics employed by many conventional bed linens may lack sufficient breathability, moisture wicking ability, conformability (e.g., drapability), pilling resistance, stain resistance, colorfastness, and/or laundering durability for sustained, long-term use of the bed linens without sacrifices to efficacy, comfort, and/or attractiveness.

BRIEF SUMMARY

Embodiments described herein include bed linens, and related bedding assemblies and methods. For example, in accordance with one embodiment described herein a bed linen comprises a single, continuous piece of fabric extending substantially completely across lateral dimensions of the bed linen and including elastomeric fibers and non-elastomeric fibers. The single, continuous piece of fabric is configured to stretch to at least 125 percent of an initial length thereof without damage thereto and to substantially return to the initial length thereof after being stretched.

In additional embodiments, a bedding assembly comprises a mattress and a bed linen at least partially covering the mattress and comprising a single, continuous piece of fabric extending substantially completely across lateral dimensions of the bed linen and including elastomeric fibers and non-elastomeric fibers. The bed linen is configured to stretch to at least 125 percent of an initial length thereof without damage thereto and to substantially return to the initial length thereof after being stretched.

In yet additional embodiments, a method of forming a bedding assembly comprises at least partially covering one or more surfaces of a cushion structure with a bed linen comprising a single, continuous piece of fabric extending substantially completely across lateral dimensions of the bed linen and including elastomeric fibers and non-elastomeric fibers. The bed linen is configured to stretch to at least 125 percent of an initial length thereof without damage thereto and to substantially return to the initial length thereof after being stretched.

DETAILED DESCRIPTION

Figure 1A:
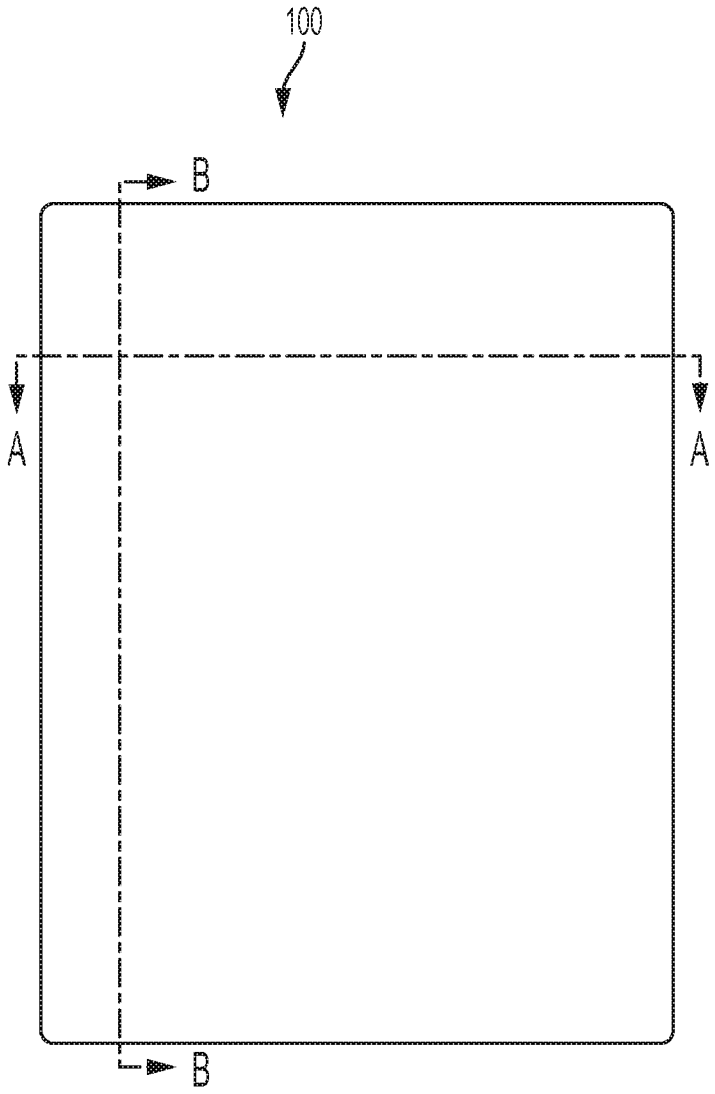
FIGS. 1A-1C are a top-down (FIG. 1A) and transverse cross-sectional (FIGS. 1B and 1C) views of a bed linen, in accordance with embodiments of the disclosure.

Bed linens are described, as are related bedding assemblies and methods. In some embodiments, a bed linen includes fabric (e.g., knitted fabric, woven fabric, unwoven fabric, etc.) having elastomeric fibers and non-elastomeric fibers. The fabric may extend substantially completely across lateral dimensions (e.g., length and width) of the bed linen, and may comprise a single, continuous unit (e.g., piece) of fabric absent (e.g., free of) seams attaching different units (e.g., different pieces) of fabric to one another across the lateral dimensions of the bed linen. The fabric of the bed linen may be highly stretchable in one or more directions (e.g., a length-wise direction, a width-wise direction, etc.), and may substantially retract to its original dimensions and shape after the removal of the distortional force effectuating the stretching. The fabric of the bed linen may also exhibit other desirable properties (e.g., desirable breathability, moisture wicking, conformability, durability, pilling resistance, stain release, colorfastness, softness, etc.) for bedding articles, and may be hemmed or unhemmed. The bed linen may be geometrically configured (e.g., sized, shaped, etc.) as any desired textile-based bedding article including, but not limited to, a sheet (e.g., a fitted sheet; an unfitted, flat sheet; a pillowcase; a duvet; a mattress pad; an anti-allergy cover; a blanket; a quilt; etc.). Optionally, the bed linen may also include one or more additional structures (e.g., elastic members, such as elastic straps, elastic bands, etc.), depending on the desired geometric configuration and end use of the bed linen. The bed linens of the disclosure, including the fabric thereof, may be more stretchable, breathable, conformable, durable, pilling resistant, stain resistant, colorfast, and/or soft than conventional bed linens.

The following description provides specific details, such as material types, shapes, sizes, and arrangements in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure or assembly. The structures described below do not necessarily form a complete structure or a complete assembly. Only those process acts and structures necessary to understand the embodiments of the disclosure are described in detail below. Additional acts to form a complete structure or a complete assembly from various structures described herein may be performed by conventional fabrication processes.

Drawings presented herein are for illustrative purposes only, and are not meant to be actual views of any particular material, component, structure, device, or assembly. Variations from the shapes depicted in the drawings as a result, for example, of manufacturing processes and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the claims. The drawings are not necessarily to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "and" and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath," or "under," or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the term "configured" refers to a size, shape, material composition, and arrangement of one or more of at least one structure and at least one apparatus facilitating operation of one or more of the at least one structure and the at least one apparatus in a pre-determined way.

Figure 1C:
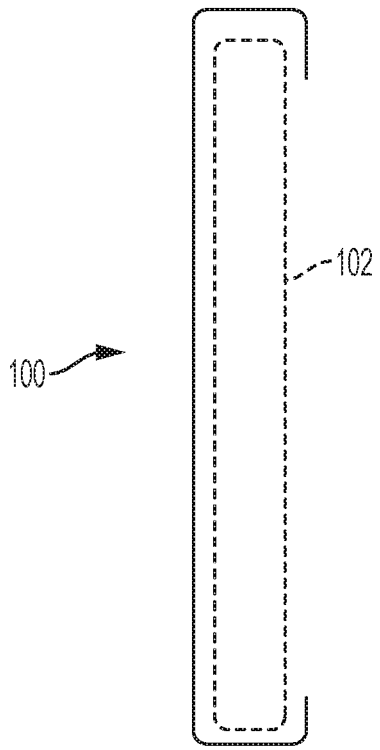
Figure 1B:
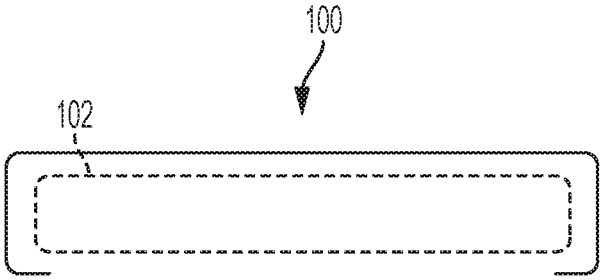

FIG. 1A illustrates a top-down view of a bed linen 100, in accordance with an embodiment of the disclosure. As used herein, the term "bed linen" refers to any bedding item (e.g., bedding article) formed of and including a textile material, such as a knitted fabric, a woven fabric, or a non-woven fabric. By way of non-limiting example, the bed linen 100 may comprise a sheet (e.g., an unfitted, flat sheet; a fitted sheet; etc.). In some embodiments, the bed linen 100 comprises a knitted bed sheet (e.g., a knitted flat sheet, a knitted fitted sheet, etc.). In additional embodiments, the bed linen 100 may comprise a different component of a bedding assembly (e.g., a pillowcase, a duvet, a mattress pad, an anti-allergy cover, a blanket, a quilt, etc.). The bed linen 100 may be configured to at least partially cover surfaces (e.g., a top surface, side surfaces, etc.) of one or more components (e.g., a mattress) of a bedding assembly. FIGS. 1B and 1C are transverse cross-sectional views of the bed linen 100 shown in FIG. 1A about lines A-A and B-B shown in FIG. 1A, respectively.

Referring collectively to FIGS. 1A through 1C, the fabric of the bed linen 100 may comprise a substantially monolithic structure. As used herein, the term "monolithic structure" refers to a continuous, unitary structure absent (e.g., free of) different components (e.g., different pieces of fabric) connected (e.g., joined, coupled, attached, etc.) to one another through one or more attachment mechanisms (e.g., fastener structures, such as stitching material, rivets, threaded fasteners, etc.). The fabric of the bed linen 100 may, for example, comprise a single (e.g., only one) piece of fabric (e.g., knitted fabric, woven fabric, non-woven fabric, etc.) extending substantially completely across lateral dimensions (e.g., a width and a length) of the bed linen 100. Accordingly, the fabric of the bed linen 100 may be entirely free of seams attaching (e.g., stitching) different pieces of fabric to one another across the lateral dimensions of the bed linen 100.

The fabric of the bed linen 100 may be formed of and include one or more fiber tows arranged in a desired pattern. In some embodiments, the fabric of the bed linen 100 is a knitted fabric comprising a single, continuous fiber tow looped repeatedly to form a desired pattern. In additional embodiments, the fabric of the bed linen 100 is a woven fabric comprising multiple fiber tows woven together to form a desired pattern. As described in further detail below, the structure and material composition of the fabric of the bed linen 100, may permit the bed linen 100 to exhibit one or more desirable properties, such as one or more of desirable elasticity, breathability, conformability (e.g., drapability), durability, pilling resistance, stain release, colorfastness, moisture wicking, and softness.

The fabric of the bed linen 100 may be configured to stretch in multiple directions (e.g., a length-wise direction and/or a width-wise direction), and to substantially return to its original (e.g., initial) dimensions and shape after being distorted (e.g., stretched). In some embodiments, the fabric of the bed linen 100 is configured to be highly distortable in at least a length-wise direction. For example, the fabric of the bed linen 100 may be configured to stretch to at least 125 percent of an original (e.g., initial) length of the bed linen 100 without failure (e.g., without rupture, without permanent wrinkling, etc.) using an applied distortional force of less than or equal to about five (5) pounds per linear inch. In addition, the fabric of the bed linen 100 may be configured to substantially return to its original shape and lateral dimensions (e.g., length, width) after being stretched (e.g., after the removal of the distortional force effectuating the stretching). For example, the fabric of the bed linen 100 may be configured to retract to a length within a five (5) percent deviation (e.g., within a four (4) percent deviation, within a three (3) percent deviation, within a two (2) percent deviation, within a one (1) percent deviation, etc.) of an original length of the bed linen 100 following each of at least 500 distortion processes wherein the bed linen 100 is stretched to at least 125 percent of the original length of the bed linen 100.

The fabric of the bed linen 100 may also be configured to be highly breathable. For example, the fabric of the bed linen 100 may be configured to permit gaseous materials (e.g., air, vapor, etc.) to migrate (e.g., travel, permeate, etc.) therethrough at a rate of at least 150 cubic feet per minute per square foot ($ft^3/min/ft^2$) when tested in accordance with ASTM Test Method D737-04 R2012, entitled *Standard Test Method for Air Permeability of Textile Fabrics*. In some embodiments, the fabric of the bed linen 100 is configured to permit air to migrate therethrough at a rate of at least 172 $ft^3/min/ft^2$ when tested in accordance with ASTM Test Method D737-04 R2012.

The fabric of the bed linen 100 may also be configured to be highly conformable. The fabric of the bed linen 100 may be configured to conform to the shape(s) of an organism (e.g., a human being) and/or structure provided thereunder such that features of the organism and/or structure are readily identifiable (e.g., distinguishable) when covered by the bed linen 100. For example, when provided on a non-planar surface of an organism or a structure without tension or constraint, the fabric of the bed linen 100 may conform to the non-planar surface without substantial amounts of bridging between elevated portions of the non-planar surface that may otherwise render one or more features (e.g., recessed portions, other elevated portions, etc.) of the non-planar surface unidentifiable (e.g., undistinguishable) when covered by a bed linen lacking the conformability of the fabric of the bed linen 100.

The fabric of the bed linen 100 may also be configured to be durable and abrasion resistant. For example, the fabric of the bed linen 100 may be configured to endure (e.g., withstand) at least 350 cycles before a hole is formed therein when tested in accordance with ASTM Test Method D3884-09 R2014, entitled *Standard Guide for Abrasion Resistance of Textile Fabrics* (*Rotary Platform, Double-Head Method*). In some embodiments, the fabric of the bed linen 100 is configured to endure at least 440 cycles before a hole is formed therein when tested in accordance with ASTM Test Method D3884-09 R2014.

The fabric of the bed linen 100 may also be configured to resist pilling. For example, the fabric of the bed linen 100 may be configured to grade at Class 4.0 or better (e.g., Class 4.5, Class 5.0) when tested in accordance with ASTM D3512/3512M-10 R2014, entitled *Standard Test Method for Pilling Resistance and Other Related Surface Changes of Textile Fabrics:* (*Random Tumble Pilling Tester*). In some embodiments, the fabric of the bed linen 100 is configured to grade at Class 4.5 or better (e.g., Class 5.0) when tested in accordance with ASTM Test Method D3512/3512M-10 R2014.

The fabric of the bed linen 100 may also be configured to effectively release stains. For example, the fabric of the bed linen 100 may be configured to grade at Class 4.0 or better (e.g., Class 4.5, Class 5.0) when tested in accordance with the American Association of Textile Chemists and Colorists (AATCC) test 130-2015, entitled *Soil Release: Oily Stain Release Method*, using blood. In some embodiments, the fabric of the bed linen 100 is configured to grade at Class 5.0 when tested in accordance with AATCC test 130-2015 using blood.

The fabric of the bed linen 100 may also be configured to have good colorfastness (e.g., resistance to the removal of color thereof) during laundering processes. For example, the fabric of the bed linen 100 may be configured to grade at Class 4.5 or better (e.g., Class 5.0) when tested in accordance with AATCC test 61-2013, entitled *Colorfastness to Laundering: Accelerated*. In some embodiments, the fabric of the bed linen 100 is configured to grade at Class 5.0 when tested in accordance with AATCC test 61-2013.

The fabric of the bed linen 100 may include any material composition facilitating the aforementioned properties thereof. For example, the fabric of the bed linen 100 may be formed of and include a combination of elastomeric fibers and non-elastomeric fibers. As used herein the term "elastomeric fiber" means and includes a polymeric fiber (e.g., a natural polymeric fiber, a synthetic polymer fiber) which, free of diluents, has a break elongation in excess of 100 percent independent of any crimp, and that when deformed (e.g., stretched) to twice its length, held for one (1) minute, and then released from the deforming force, retracts to less than one and one-half (1.5) times its original length within one (1) minute of the removal of the deforming force. In some embodiments, such as in embodiments wherein the fabric of the bed linen 100 comprises a knitted fabric, each (e.g., the only) fiber tow of the fabric of the bed linen 100 may independently include a blend of elastomeric fibers and non-elastomeric fibers. In additional embodiments, such as in embodiments wherein the fabric of the bed linen 100 comprises a woven fabric, at least one fiber tow of the fabric of the bed linen 100 may include elastomeric fibers, and at least one other fiber tow of the fabric of the bed linen 100 may include non-elastomeric fibers. For example, a first fiber tow of the fabric of the bed linen 100 may only include elastomeric fibers, and a second fiber tow of the fabric of the bed linen 100 may only include non-elastomeric fibers. As another example, a first fiber tow of the fabric of the bed linen 100 may include elastomeric fibers and non-elastomeric fibers, and a second fiber tow of the fabric of the bed linen 100 may include one or more of a different type and different quantity of one or more of elastomeric fibers and non-elastomeric fibers than the first fiber tow.

Non-limiting examples of suitable elastomeric fibers for the fabric of the bed linen 100 include spandex fibers, rubber fibers, polyetherester fibers, polyetheramide fibers, polypropylene fibers, and elastoester fibers. In some embodiments at least some (e.g., all) of the elastomeric fibers of the fabric of the bed linen 100 comprise spandex fibers. As used herein, the term "spandex fiber" means and includes a manufactured fiber in which the fiber-forming substance is a long chain synthetic elastomer comprised of at least 85 percent by weight (wt %) of a segmented polyurethane.

Non-limiting examples of suitable non-elastomeric fibers for the fabric of the bed linen 100 include rayon fibers, silk fibers, linen fibers, cotton fibers, hemp fibers, wool fibers, polyester fibers, polyamide fibers (e.g., nylon fibers), acrylic fibers, and acetate fibers. In some embodiments at least some (e.g., all) of the non-elastomeric fibers of the fabric of the bed linen 100 comprise rayon fibers. As used herein, the term "rayon fiber" means and includes a synthetic fiber manufactured from cellulose fiber extracted from plant material (e.g., wood pulp). In some embodiments wherein the fabric of the bed linen 100 includes rayon fibers, at least some (e.g., all) of the rayon fibers may be formed from bamboo. Bamboo-based-rayon fibers may be softer than various other non-elastomeric fibers (e.g., linen fibers, cotton fibers, hemp fibers, wool fibers, etc.), may exhibit desirable moisture wicking properties, may readily withstand numerous laundering processes, and may require less dye to color than various other non-elastomeric fibers (e.g., cotton fibers, etc.).

The fabric of the bed linen 100 may include any desired quantities (e.g., amounts) of elastomeric fibers and non-elastomeric fibers facilitating the properties of the fabric previously described herein. The fabric of the bed linen 100 may, for example, include greater than or equal to about six (6) wt % (e.g., greater than or equal to about eight (8) wt %, greater than or equal to about ten (10) wt %, greater than or equal to about twelve (12) wt %, or greater than or equal to about thirteen (13) wt %) elastomeric fibers, and a remainder of the fabric of the bed linen 100 may comprise non-elastomeric fibers. As a non-limiting example, the fabric of the bed linen 100 may include greater than or equal to about six (6) wt % spandex fibers, and a remainder of the fabric of the bed linen 100 may comprise bamboo-based-rayon fibers. In some embodiments, the fabric of the bed linen 100 comprises about thirteen (13) wt % spandex fibers, and about 87 wt % bamboo-based-rayon fibers. In such embodiments, a total weight of the fabric of the bed linen 100 may be about 200 grams per square meter ($g/m^2$).

With continued reference to FIGS. 1A through 1C, the bed linen 100 may exhibit any desired lateral peripheral shape including, but not limited to, a rectangular shape, another tetragonal shape (e.g., a square shape, a trapezium shape, a trapezoidal shape, a parallelogram shape, a kite shape, a rhomboidal shape, etc.), a circular shape, a semicircular shape, a crescent shape, an ovular shape, an astroidal shape, a deltoidal shape, an ellipsoidal shape, a triangular shape, a pentagonal shape, a hexagonal shape, a heptagonal shape, an octagonal shape, an enneagonal shape, a decagonal shape, truncated versions thereof, or an irregular peripheral shape. In some embodiments, the bed linen 100 exhibits a rectangular lateral peripheral shape. The shape of the bed linen 100 may be selected at least partially based on a shape of another component (e.g., a mattress) of a bedding assembly to be at least partially covered by the bed linen 100. By way of non-limiting example, in some embodiments, the bed linen 100 exhibits a substantially rectangular lateral peripheral shape complementary (e.g., corresponding) to a substantially rectangular lateral peripheral shape of a mattress to be at least partially covered by the bed linen 100. In addition, corners of the bed linen 100 (if any) may exhibit any desired shape, such as a rounded (e.g., arcuate) shape, a sharp (e.g., non-rounded) shape, or a combination thereof. In some embodiments, corners of the bed linen 100 exhibit a sharp configuration wherein adjacent peripheral edges of the bed linen 100 meet at about a ninety (90) degree angle.

The bed linen 100 may exhibit any desired dimensions (e.g., length, width, and thickness). Lateral dimensions (e.g., length, width) of the bed linen 100 may be selected at least partially based on lateral dimensions of another component (e.g., a mattress) of a bedding assembly to be at least partially covered by the bed linen 100. As a non-limiting example, referring collectively to FIGS. 1B and 1C, lateral dimensions of the bed linen 100 may be selected such that the bed linen 100 at least partially covers an upper surface and side surfaces of a mattress 102 (shown by dashed lines) having desired dimensions (e.g., length, width, and thickness). The bed linen 100 may, for example, be sized to cover each of an upper surface, side surfaces, and portions (e.g., peripheral portions) of a bottom surface of the mattress 102 when the bed linen 100 is directly adjacent the mattress 102 and at rest. For example, in some embodiments wherein the bed linen 100 comprises an unfitted, flat sheet, the lateral dimensions of the bed linen 100 may be selected such that the bed linen 100 covers an upper surface of the mattress 102, at least three (3) side surfaces of the mattress 102, and peripheral portions of a bottom surface of the mattress 102 adjacent the at least three (3) side surfaces of the mattress 102 (e.g., portions of the bottom surface of the mattress 102 each independently inwardly laterally extending up to about six (6) inches from a side surface of the mattress 102 adjacent thereto). As another example, in some embodiments wherein the bed linen 100 comprises a fitted sheet, the lateral dimensions of the bed linen 100 may be selected such that the bed linen 100 covers an upper surface of the mattress 102, four (4) side surfaces of the mattress 102, and peripheral portions of a bottom surface of the mattress 102 adjacent the four (4) side surfaces of the mattress 102 (e.g., portions of the bottom surface of the mattress 102 each independently inwardly laterally extending up to about four (4) inches from a side surface of the mattress 102 adjacent thereto, such as up to about two (2) inches from a side surface of the mattress 102 adjacent thereto).

In some embodiments, lateral dimensions of the bed linen 100 are selected such that the bed linen 100 substantially (e.g., completely) covers an upper surface and at least three (3) side surfaces (e.g., three (3) side surfaces, four (4) side surfaces) of a queen-size mattress, a full-size mattress, or an extra-long full-size mattress when the bed linen 100 is directly adjacent the queen-size mattress, the full-size mattress, or the extra-long full-size mattress and is at rest. The bed linen 100 may also be sized to cover peripheral portions of a bottom surface adjacent the at least three (3) side surfaces of the queen-size mattress, the full-size mattress, or the extra-long full-size mattress. Furthermore, in embodiments wherein the bed linen 100 comprises a fitted sheet, lateral dimensions of the bed linen 100 may account for stretch to the bed linen 100 that will be employed to fit the bed linen 100 around the queen-size mattress, the full-size mattress, or the extra-long full-size mattress. The initial (e.g., original, non-stretched) lateral area the bed linen 100 may, for example, be less than the surface area cumulatively encompassed by the upper surface, the four (4) side surfaces, and two (2) inches into and around an entire periphery of the bottom surface of the queen-size mattress, the full-size mattress, or the extra-long full-size mattress. As a non-limiting example, if the bed linen 100 comprises a fitted sheet and the mattress 102 exhibits a width of about 60 inches, a length of about 80 inches, and a thickness of about 12 inches, the bed linen 100 may exhibit a width of about 81.5 inches and a length of about 94 inches.

In additional embodiments, lateral dimensions of the bed linen 100 are selected such that the bed linen 100 substantially (e.g., completely) covers an upper surface and at least three (3) side surfaces (e.g., three (3) side surfaces, four (4) side surfaces) of a king-size mattress or a California-king-size mattress when the bed linen 100 is directly adjacent the king-size mattress or the California-king-size mattress and is at rest. The bed linen 100 may also be sized to cover peripheral portions of a bottom surface adjacent the at least three (3) side surfaces of the king-size mattress or the California-king-size mattress. Furthermore, in embodiments wherein the bed linen 100 comprises a fitted sheet, lateral dimensions of the bed linen 100 may account for stretch to the bed linen 100 that will be employed to fit the bed linen 100 around the king-size mattress or the California-king-size mattress. The initial (e.g., original, non-stretched) lateral area the bed linen 100 may, for example, be less than the surface area cumulatively encompassed by the upper surface, the four (4) side surfaces, and two (2) inches into and around an entire periphery of the bottom surface of the king-size mattress or the California-king-size mattress. As a non-limiting example, if the bed linen 100 comprises a fitted sheet and the mattress 102 exhibits a width of about 76 inches, a length of about 80 inches, and a thickness of about 12 inches, the bed linen 100 may exhibit a width of about 97.5 inches and a length of about 94 inches.

In further embodiments, lateral dimensions of the bed linen 100 are selected such that the bed linen 100 substantially (e.g., completely) covers an upper surface and at least three (3) side surfaces (e.g., three (3) side surfaces, four (4) side surfaces) of a twin-size mattress or an extra-long-twin-size mattress when the bed linen 100 is directly adjacent the twin-size mattress or the extra-long-twin-sized mattress and is at rest. The bed linen 100 may also be sized to cover peripheral portions of a bottom surface adjacent the at least three (3) side surfaces of the twin-size mattress or the extra-long-twin-size mattress. Furthermore, in embodiments wherein the bed linen 100 comprises a fitted sheet, lateral dimensions of the bed linen 100 may account for stretch to the bed linen 100 that will be employed to fit the bed linen 100 around the twin-size mattress or the extra-long-twin-size mattress. The initial (e.g., original, non-stretched) lateral area the bed linen 100 may, for example, be less than the surface area cumulatively encompassed by the upper surface, the four (4) side surfaces, and two (2) inches into and around an entire periphery of the bottom surface of the twin-size mattress or the extra-long-twin-size mattress. As a non-limiting example, if the bed linen 100 comprises a fitted sheet and the mattress 102 exhibits a width of about 38 inches, a length of about 80 inches, and a thickness of about 12 inches, the bed linen 100 may exhibit a width of about 59.5 inches and a length of about 94 inches.

Optionally, one or more lateral peripheral portions of the fabric of the bed linen 100 may be hemmed. One or more portions of the fabric of the bed linen 100 proximate one or more peripheral lateral edges of the fabric of the bed linen 100 may be folded over one or more other portions of the fabric of the bed linen 100 proximate thereto and then sewn in place. For example, if the fabric of the bed linen 100 exhibits a substantially rectangular lateral peripheral shape, one or more (e.g., each) of the four (4) lateral sides of the fabric of the bed linen 100 may be hemmed. In some embodiments, an entire lateral periphery of the fabric of the bed linen 100 is hemmed. If the fabric of the bed linen 100 includes multiple hemmed lateral sides, each of the lateral sides may exhibit substantially the same hem depth as each other of the lateral sides of the fabric of the bed linen 100, or at least one of the lateral sides of the fabric of the bed linen 100 may exhibit a different hem depth than at least one other of the lateral sides of the fabric of the bed linen 100. In some embodiments, each lateral side of the fabric of the bed linen 100 independently exhibits a hem depth within a range of from about one-quarter (0.25) inch to about six (6) inches. For example, if the fabric of the bed linen 100 exhibits a substantially rectangular lateral peripheral shape, one of the four (4) lateral sides of the fabric of the bed linen 100 may exhibit a hem depth of about four (4) inches, and each of the other three (3) lateral sides of the fabric of the bed linen 100 may exhibit a hem depth of about one-half (0.5) inch.

In addition, in some embodiments, such as embodiments wherein the bed linen 100 comprises a fitted sheet, one or more elastic members (e.g., elastic straps, elastic bands, etc.) may, optionally, be attached proximate one or more peripheral lateral edges of the bed linen 100. For example, one or more elastic members may be attached (e.g., sewn to, provided within a hem fold, etc.) to portions of adjacent peripheral lateral edges of the fabric of the bed linen 100 proximate corners of the bed linen 100. As another example, one or more elastic members attached (e.g., sewn, provided within a hem fold, etc.) to the fabric of the bed linen 100 may extend parallel to and at least partially (e.g., completely) across one or more of the peripheral lateral edges of the fabric of the bed linen 100. In some embodiments, at least one elastic member is attached (e.g., sewn, provided within a hem fold, etc.) proximate to and extends substantially completely around an entire lateral periphery of the fabric of the bed linen 100. In additional embodiments, the bed linen 100 includes a different means of securing the bed linen 100 to another structure. As a non-limiting example, adjacent lateral edges of the bed linen 100 may be sewn or otherwise coupled (e.g., laced) together at corners of the bed linen 100 to permit the corners of the bed linen 100 to be secured to corners of another structure (e.g., a mattress) of a bedding assembly. As another non-limiting example, the bed linen 100 may be coupled to another structure through another attachment means, such a tack-and-jump interior quilting.

Figure 2A:
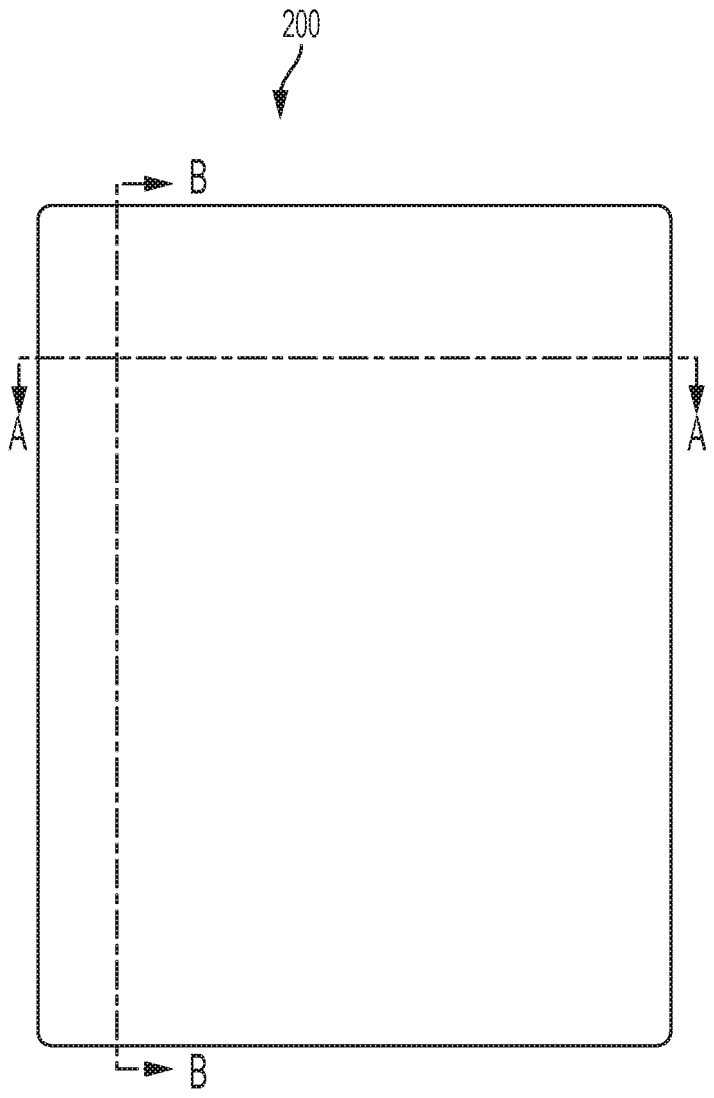
FIGS. 2A-2C are a top-down (FIG. 2A) and transverse cross-sectional (FIGS. 2B and 2C) views of a bed linen, in accordance with additional embodiments of the disclosure.
Figure 2C:
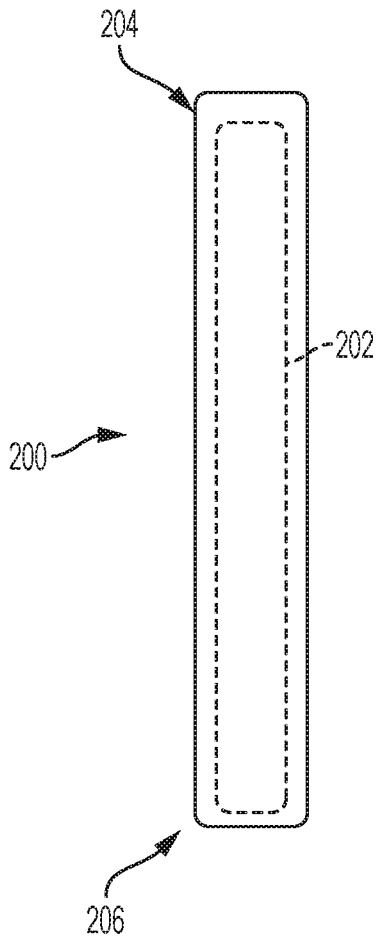
Figure 2B:
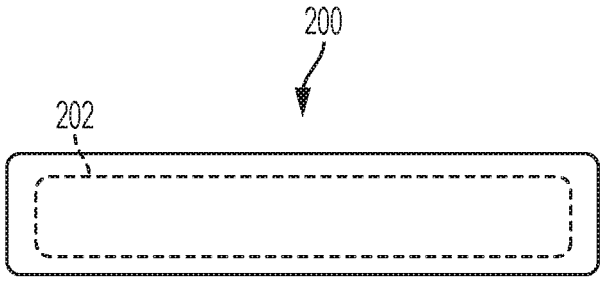

As previously discussed, in additional embodiments, the bed linen 100 may exhibit a different geometric configuration (e.g., a different shape, different dimensions, etc.) than that depicted in FIGS. 1A through 1C. The bed linen 100 may, for example, be formed to exhibit a geometric configuration complementary to a non-mattress component of bedding assembly, such as one or more of a pillow, a cushion (e.g., a non-mattress cushion), and a comforter. By way of non-limiting example, FIG. 2A is a top-down view of a bed linen 200, in accordance with additional embodiments of the disclosure. The bed linen 200 may, for example, be configured to function as a pillowcase. FIGS. 2B and 2C are transverse cross-sectional views of the bed linen 200 shown in FIG. 2A about lines A-A and B-B shown in FIG. 2A, respectively.

Referring collectively to FIGS. 2A through 2C, the bed linen 200 may exhibit any geometric configuration (e.g., shape and size) able to substantially surround (e.g., envelop, cover, etc.) sides of at least one structure (e.g., a pillow, a cushion, etc.) to be at least partially (e.g., substantially) contained within the bed linen 200. As shown in FIGS. 2B and 2C, in some embodiments, the bed linen 200 is configured to substantially (e.g., completely) cover an upper surface, a lower surface, and at least some side surfaces of a pillow 202. The bed linen 200 may, for example, be configured to wrap entirely around the pillow 202, and may include an open end 204 configured to receive the pillow 202 and a closed end 206 opposite the open end 204. The bed linen 200 may substantially completely cover an upper surface, a lower surface, and at least three (3) out of four (4) side surfaces of the pillow 202. The bed linen 200 may include a single (e.g., only one) piece of fabric folded and sewn at different locations to facilitate the desired geometric configuration of the bed linen 200. For example, portions of the single piece of fabric of the bed linen 200 may be sewn at the closed end 206 of the bed linen 200 and at one or more locations between the open end 204 and the closed end 206. In additional embodiments, the bed linen 200 may be geometrically configured to receive and surround the pillow 202 in a different manner. By way of non-limiting example, the bed linen 200 may be configured to wrap entirely around the pillow 202, and may include opposing, closed ends and an opening positioned between the opposing, closed ends and configured to receive the pillow 202.

A lateral peripheral shape of the bed linen 200 may be selected at least partially based on a lateral peripheral shape of a structure (e.g., the pillow 202 shown in FIGS. 2B and 2C) to be contained within the bed linen 200. By way of non-limiting example, as shown in FIGS. 2A through 2C, in some embodiments, the bed linen 200 exhibits a substantially rectangular lateral peripheral shape complementary (e.g., corresponding) to a substantially rectangular lateral peripheral shape of the pillow 202 (FIGS. 2B and 2C) to be contained within the bed linen 200. In additional embodiments, the bed linen 200 may exhibit a different lateral peripheral shape, such as another tetragonal shape (e.g., a square shape, a trapezium shape, a trapezoidal shape, a parallelogram shape, a kite shape, a rhomboidal shape, etc.), a circular shape, a semicircular shape, a crescent shape, an ovular shape, an astroidal shape, a deltoidal shape, an ellipsoidal shape, a triangular shape, a pentagonal shape, a hexagonal shape, a heptagonal shape, an octagonal shape, an enneagonal shape, a decagonal shape, truncated versions thereof, or an irregular peripheral shape. In addition, corners of the bed linen 200 (if any) may exhibit any desired shape, such as a rounded (e.g., arcuate) shape, a sharp (e.g., non-rounded) shape, or a combination thereof. In some embodiments, corners of the bed linen 200 exhibit a sharp configuration wherein adjacent peripheral edges of the bed linen 200 meet at about a ninety (90) degree angle.

Optionally, one or more lateral peripheral portions of the bed linen 200 may be hemmed. One or more portions of the fabric of the bed linen 200 proximate one or more peripheral lateral edges of the bed linen 200 may be folded over one or more other portions of the fabric of the bed linen 200 proximate thereto and then sewn in place. For example, referring to FIG. 2C, peripheral lateral edges of the fabric of the bed linen 200 defining the open end 204 of the bed linen 200 may be hemmed. In some embodiments, one or more peripheral lateral edges of the fabric of the bed linen 200 independently exhibit a hem depth within a range of from about one-quarter (0.25) inch to about six (6) inches. For example, peripheral lateral edges of the fabric of the bed linen 200 defining the open end 204 shown in FIG. 2C may exhibit a hem depth of about four (4) inches.

In addition, in some embodiments, one or more closing members (e.g., zippers, snaps, buttons, VELCRO® straps, etc.) may, optionally, be attached proximate one or more peripheral lateral edges of the bed linen 200. For example, one or more closing members may be attached (e.g., sewn) to portions of adjacent peripheral lateral edges of the fabric of the bed linen 200 defining the open end 204 thereof. In some embodiments, at least one closing member is sewn completely around an entire lateral periphery of the fabric of the bed linen 200 defining an opening (e.g., the open end 204) in the bed linen 200. The closing member may, for example, assist with the retention of one or more structures (e.g., the pillow 202 shown in FIGS. 2B and 2C) within the bed linen 200.

The fabric of the bed linen 200 may have a structure and material composition substantially similar to the fabric of the bed linen 100 previously described with respect to FIGS. 1A through 1C. The fabric (e.g., knitted fabric, woven fabric, unwoven fabric) of the bed linen 200 may formed of and include one or more fiber tows arranged in a desired pattern, and may include a combination of elastomeric fibers (e.g., spandex fibers) and non-elastomeric fibers (e.g., bamboo-based-rayon fibers). In some embodiments, the fabric of the bed linen 200 is a knitted fabric comprising a single, continuous fiber tow looped repeatedly to form a desired pattern. Similar to the bed linen 100 (FIGS. 1A through 1C), the structure and material composition of the fabric of the bed linen 200, may permit the bed linen 200 to exhibit one or more desirable properties, such as one or more of desirable elasticity, breathability, conformability (e.g., drapability), durability, pilling resistance, stain release, colorfastness, moisture wicking, and softness.

Figure 3:
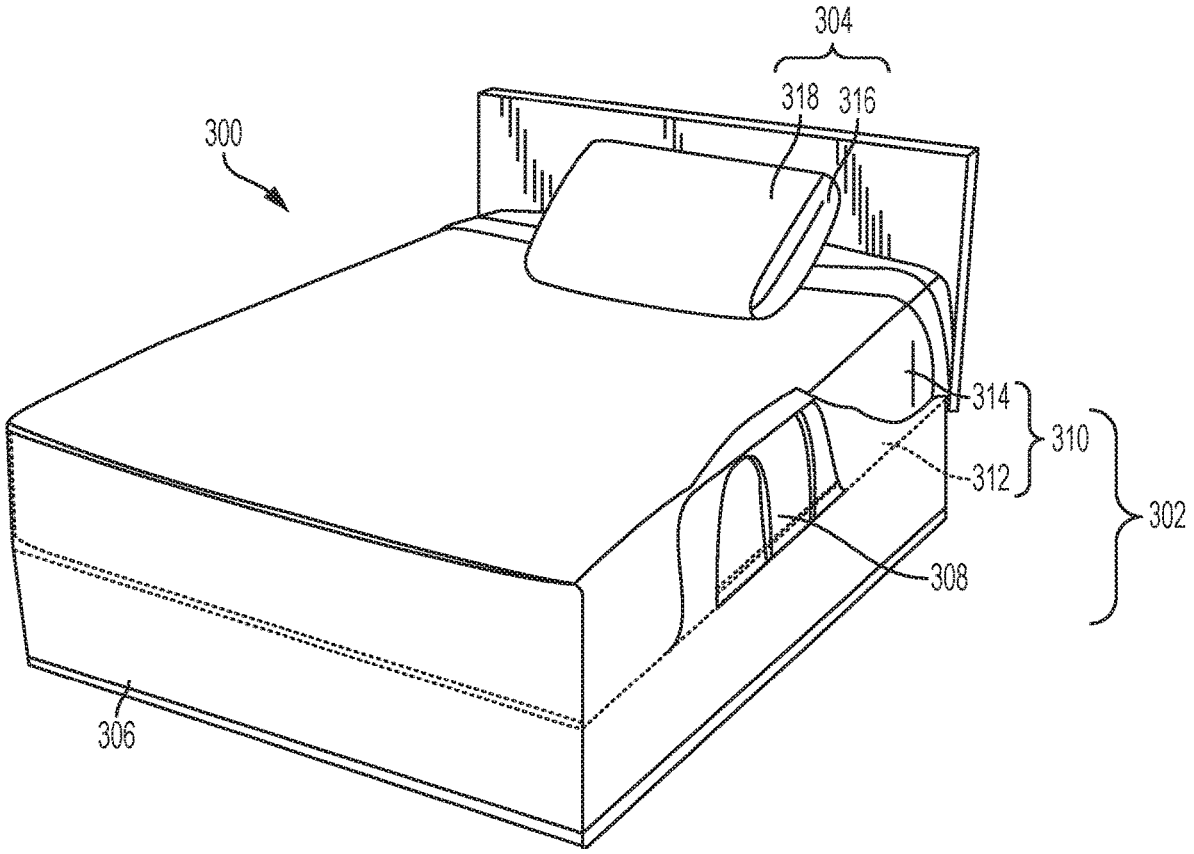
FIG. 3 is a perspective view of a bedding assembly, in accordance with embodiments of the disclosure.

As previously discussed, bed linens (e.g., the bed linen 100, the bed linen 200) in accordance with embodiments of the disclosure may be included in embodiments of bedding assemblies of the disclosure. For example, FIG. 3 is a simplified perspective view of a bedding assembly 300 according to embodiments of disclosure. The bedding assembly 300 may include a mattress assembly 302, and, optionally, at least one pillow assembly 304 on or over the mattress assembly 302. The mattress assembly 302 may be positioned on or over a supporting structure 306 (e.g., a mattress foundation, a bed frame, etc.), and may include a mattress 308 and one or more sheets 310 (e.g., fitted sheets; unfitted, flat sheets, etc.) on or over the mattress 308. The sheets 310 may, for example, include a fitted sheet 312 on the mattress 308 and an unfitted, flat sheet 314 on the fitted sheet 312. One or more of the sheets 310 (e.g., the fitted sheet 312 and/or the unfitted, flat sheet 314) may comprise an embodiment of the bed linen 100 previously described with reference to FIGS. 1A through 1C. The pillow assembly 304 (if any) may include a pillow 316 (e.g., non-mattress cushion), and a pillowcase 318 on the pillow 316. The pillowcase 318 may comprise an embodiment of the bed linen 200 previously described with reference to FIGS. 2A through 2C. While FIG. 3 depicts a particular configuration of the bedding assembly 300, one of ordinary skill in the art will appreciate that the bedding assembly 300 may exhibit a different configuration, such as a configuration exhibiting one or more of a different size, a different shape, different features, different feature spacing, different components, and a different arrangement of components. FIG. 3 illustrates just one non-limiting example of the bedding assembly 300.

In some embodiments, one or more of the mattress 308 of the mattress assembly 302 and the pillow 316 of the pillow assembly 304 may be formed of and include an elastomeric polymer cushion including buckling walls defining columnar voids extending within the elastomeric polymer cushion. Examples of such elastomeric polymer cushions are disclosed in, for example, U.S. Pat. No. 5,749,111 issued May 12, 1998 to Pearce, U.S. Pat. No. 6,026,527 issued Feb. 22, 2000 to Pearce, U.S. Pat. No. 6,413,458 issued Jul. 2, 2002 to Pearce, U.S. Pat. No. 8,919,750 issued Dec. 30, 2014 to Pearce et al., the disclosure of each of which is incorporated herein in its entirety by this reference.

Figure 4:
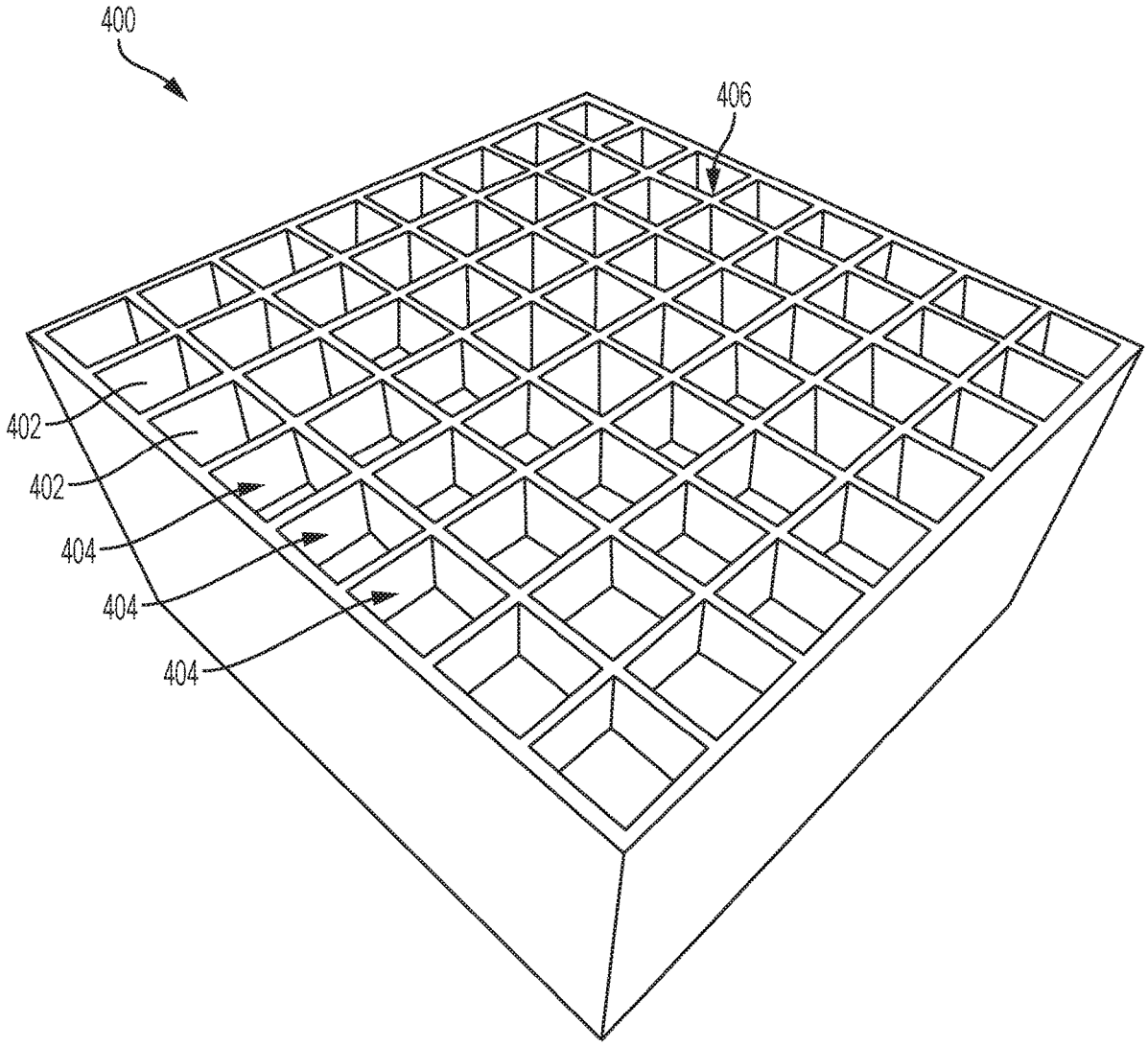
FIG. 4 is a perspective view of a portion of an elastomeric polymer cushion of the bedding assembly shown in FIG. 3, in accordance with embodiments of the disclosure.

FIG. 4 is a perspective view of a portion of an elastomeric polymer cushion 400 that may be used as one or more of the mattress 308 and the pillow 316 shown in FIG. 3. As shown in FIG. 4, the elastomeric polymer cushion 400 includes buckling walls 402 defining columnar voids 404 extending within the elastomeric polymer cushion 400 generally along a direction perpendicular to a cushioning surface 406 of the elastomeric polymer cushion 400. The buckling walls 402 are configured to buckle when a force applied to the cushioning surface 406 exceeds a threshold level. The buckling walls 402 are interconnected to one another and part of a single, integral volume of material. As shown in FIG. 4, in some embodiments, the buckling walls 402 are oriented in two directions, intersecting at right angles, and define square voids 404. In additional embodiments, the buckling walls 402 intersect one another at a different angle. For example, the buckling walls 402 may intersect one another at non-right angles (e.g., acute angles, obtuse angles) and may define voids 404 of non-square lateral shapes (e.g., triangular shapes, other rectangular shapes, hexagonal shapes, combinations thereof, etc.).

The buckling walls 402 of the elastomeric polymer cushion 400 may be formed of and include an elastomeric material. As used herein, the term "elastomeric material" refers to a material including one or more elastomeric polymers. The elastomeric material may only include at least one elastomeric polymer, or may include a mixture of at least one elastomeric polymer and one or more other materials (e.g., plasticizers, such as white paraffinic mineral oil; pigments; antioxidants; etc.). In some embodiments, the elastomeric material comprises a mixture of elastomeric polymer and plasticizer, and includes a plasticizer-to-polymer ratio from about 0.1:1 to about 50:1 by weight (e.g., from about 1:1 to about 30:1 by weight, from about 1.5:1 to about 10:1 by weight, or about 4:1 by weight). As used herein, the term "elastomeric polymer" means and includes a polymer capable of recovering its original size and shape after deformation. Non-limiting examples of elastomeric polymers include homopolymers (e.g., polymers having a single chemical unit repeated); and copolymers (e.g., polymers having two or more chemical units), such as elastomeric block copolymers. As used herein, the term "elastomeric block copolymer" means and includes an elastomeric polymer having groups or blocks of homopolymers linked together, such as A-B diblock copolymers and A-B-A triblock copolymers (e.g., styrene ethylene propylene styrene (SEPS), styrene ethylene butylene styrene (SEBS), styrene ethylene ethylene propylene styrene (SEEPS), etc.). A-B diblock copolymers have two distinct blocks of homopolymers. A-B-A triblock copolymers have two blocks of a single homopolymer (A) each linked to a single block of a different homopolymer (B). The elastomeric material may be non-sticky and rubbery in feel, but may deform to the shape of a structure applying a deforming force better than conventional rubber materials, and may have a durometer hardness lower than conventional rubber materials. For example, the elastomeric material may have a hardness on the Shore A scale of less than about 50, from about 0.1 to about 50, or less than about 5. In addition, the elastomeric material may be formulated such that buckling walls 402 do not stick to one another or do not remain stuck to one another after a deforming force applied to the buckling walls 402 is removed. Suitable elastomeric materials include, without limitation, gelatinous elastomers (also referred to in the art as gels, elastomer gels, or elastomeric gels), thermoplastic elastomers, natural rubbers, synthetic elastomers, and blends of natural and synthetic elastomers.

In some embodiments, the buckling walls 402 are formed of and include at least one of the elastomeric materials described in one or more of U.S. Pat. No. 5,994,450, issued Nov. 30, 1999, and entitled "Gelatinous Elastomer and Methods of Making and Using the Same and Articles Made Therefrom"; U.S. Pat. No. 7,964,664, issued Jun. 21, 2011, and entitled "Gel with Wide Distribution of MW in Mid-Block"; and U.S. Pat. No. 4,369,284, issued Jan. 18, 1983, and entitled "Thermoplastic Elastomer Gelatinous Compositions"; the disclosures of each of which are incorporated herein in their entirety by this reference.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A bed, comprising:

a mattress comprising an elastomeric cushioning element with a hardness of 15 A or less and including interconnected buckling walls that define columnar voids extending substantially through the elastomeric cushioning element; and a bed linen comprising a single, continuous piece of fabric extending substantially completely across lateral dimensions of the bed linen, the single, continuous piece of fabric knitted from at least one fiber tow including elastomeric fibers and non-elastomeric fibers, and having a stretchability of at least 125 percent of an initial length of the single, continuous piece of fabric, the single, continuous piece of fabric configured to substantially return to initial dimensions thereof after being stretched.

2. The bed of claim 1, wherein the single, continuous piece of fabric comprises a single, continuous fiber tow of the elastomeric fibers and the non-elastomeric fibers.

3. The bed of claim 1, wherein the single, continuous piece of fabric is free of seams fixedly adjoining the single, continuous piece of fabric to one or more other pieces of fabric across the lateral dimensions of the bed linen.

4. The bed of claim 1, wherein the single, continuous piece of fabric exhibits a width greater than or equal to about 59.5 inches and a length greater than or equal to about 94 inches.

5. The bed of claim 1, wherein the single, continuous piece of fabric is configured to retract to a length within 5 percent deviation of the initial length of the single, continuous piece of fabric following each of at least 500 distortion processes wherein the single, continuous piece of fabric is stretched to at least 125 percent of the initial length of the single, continuous piece of fabric.

6. The bed of claim 1, wherein the single, continuous piece of fabric is configured to permit gaseous materials to migrate therethrough at a rate of at least 150 $ft^3/min/ft^2$ when tested in accordance with ASTM Test Method D737-04 R2012.

7. The bed of claim 1, wherein the single, continuous piece of fabric comprises multiple fiber tows, each independently comprising a portion of the elastomeric fibers and a portion of the non-elastomeric fibers.

8. The bed of claim 1, wherein the elastomeric fibers comprise spandex fibers and the non-elastomeric fibers comprise bamboo-based-rayon fibers.

9. The bed of claim 1, wherein the single, continuous piece of fabric is folded and sewn at different locations so as to exhibit an open end configured to receive a structure therein and a closed end opposing the open end.

10. The bed of claim 1, wherein the single, continuous piece of fabric is hemmed about a lateral periphery thereof.

11. The bed of claim 1, further comprising at least one elastic structure attached proximate one or more lateral edges of the single, continuous piece of fabric.

12. A bed and bedding, together comprising:

a mattress comprising an elastomeric gel or viscoelastic gel with a hardness of 15 A or less; and a bed linen at least partially covering the mattress and comprising a single, continuous piece of fabric extending substantially completely across lateral dimensions of the bed linen, the single, continuous piece of fabric knitted from at least one fiber tow including elastomeric fibers and non-elastomeric fibers, and having a stretchability of at least 125 percent of an initial length of the single, continuous piece of fabric, the bed linen configured to substantially return to the initial length thereof after being stretched.

13. The bed and bedding of claim 12, wherein the bed linen comprises a sheet, a duvet, a mattress pad, an anti-allergy cover, a blanket, or a quilt.

14. The bed and bedding of claim 12, wherein the bed linen comprises a fitted sheet or an unfitted, flat sheet.

15. The bed and bedding of claim 12, wherein a remainder of the single, continuous piece of fabric comprises bamboo-based-rayon fibers.

16. The bed and bedding of claim 12, wherein the mattress comprises an elastomeric polymer cushion comprising:

interconnected walls comprising an elastomeric material; and columnar voids extending between the interconnected walls.

17. The bed and bedding of claim 12, further comprising:

a pillow; and a pillowcase at least partially covering the pillow and comprising another single, continuous piece of fabric including additional elastomeric fibers and additional non-elastomeric fibers, the pillowcase configured to substantially return to initial dimensions thereof after being stretched.

18. The bed and bedding of claim 17, wherein a material composition of the pillowcase is substantially the same as a material composition of the bed linen.

19. A method of arranging a bed, comprising:

selecting a cushion with an elastomeric cushioning element having a durometer of 15 A or less; and at least partially covering one or more surfaces of the cushion with a bed linen comprising a single, continuous piece of fabric extending substantially completely across lateral dimensions of the bed linen, the single, continuous piece of fabric knitted from at least one fiber tow including elastomeric fibers and non-elastomeric fibers, and having a stretchability of at least 125 percent of an initial length of the single, continuous piece of fabric, the bed linen configured to substantially return to initial dimensions thereof after being stretched.

* * * * *